US007861325B2

(12) United States Patent
Chou

(10) Patent No.: US 7,861,325 B2
(45) Date of Patent: Jan. 4, 2011

(54) SWIMMING GOGGLES WITH STRAP POSITIONING FUNCTION

(76) Inventor: Terry Chou, No.12, Hsin Ho Herng Road, Tainan City (TW)

( * ) Notice: Subject to any disclaimer, the term of this patent is extended or adjusted under 35 U.S.C. 154(b) by 409 days.

(21) Appl. No.: 12/126,903

(22) Filed: May 25, 2008

(65) Prior Publication Data

US 2009/0288243 A1 Nov. 26, 2009

(51) Int. Cl.
*A61F 9/02* (2006.01)

(52) U.S. Cl. ..... 2/448

(58) Field of Classification Search ..... 2/426, 2/428, 448

See application file for complete search history.

(56) References Cited

U.S. PATENT DOCUMENTS 5,857,221 A * 1/1999 Geneve et al. ..... 2/428
6,321,390 B1 * 11/2001 Chiang ..... 2/428
6,581,213 B2 * 6/2003 Chiang ..... 2/428

* cited by examiner

*Primary Examiner*—Katherine Moran
(74) *Attorney, Agent, or Firm*—Banger Shia

(57) ABSTRACT

A pair of swimming goggles includes a body having a strap coupling section formed on each of two sides thereof. Each strap coupling section includes front and rear faces, with upper and lower grooves formed in the front face. Each groove includes a slot in an outer end thereof and a through-hole in an inner end thereof. The slots and the through-holes extend from the front face through the rear face. A head strap includes two ends each extending in sequence through one of the slots, one of the grooves, one of the through-holes, the other through-hole, the other groove, and the other slot, with the head strap forming upper and lower clamping sections.

2 Claims, 10 Drawing Sheets

SWIMMING GOGGLES WITH STRAP POSITIONING FUNCTION

BACKGROUND OF THE INVENTION

The present invention relates to a pair of swimming goggles and, more particularly, to a pair of swimming goggles with a reliable strap positioning function.

Typical swimming goggles generally include a head strap to keep the body of the swimming goggles in airtight contact with the eye sockets of a user. FIG. 7 shows a pair of conventional swimming goggles including a body 1' having a strap coupling section 11' on each of two outer sides thereof. Each strap coupling section 11' has a through-hole 12' extending perpendicularly to a direction indicted by arrow A. A head strap 2' made of elastic material is extended through through-holes 12' of strap coupling sections 11' and folded to form upper and lower clamping sections 21' and 22'. A buckle 23' is coupled with head strap 2' to allow adjustment of a clamping length of head strap 2'. With reference to FIG. 8, in use, upper and lower clamping sections 21' and 22' extend around upper and lower portions of a rear of the head of the user to provide stable clamping. However, bifurcation 13' of upper and lower clamping sections 21' and 22' can not provide a reliable positioning effect such that lower clamping section 22' is liable to be moved downward by water stream or by movement of the head of the user to a position pressing against the ears of the user, leading to discomfort to the user. Furthermore, bifurcation 13' fails to provide an aesthetically integral impression.

FIG. 9 shows another pair of conventional swimming goggles including a body 3' having a strap coupling section 31' on each of two outer sides thereof. FIG. 10 shows a schematic side view illustrating a user wearing the swimming goggles of FIG. 9. Each strap-coupling section 31' has a through-hole 32' extending perpendicularly to a direction indicted by arrow B. Two head straps 4' and 5' made of elastic material are respectively extended through through-holes 32' and each include a buckle 41', 51' formed on an end thereof to couple with the other end of the other head strap 5', 4', forming upper and lower clamping sections 43' and 44'. Two sleeves 6' are provided to clamp head straps 4' and 5' to prevent lower clamping section 44' from pressing against the ears of the user. However, sleeves 6' cause an increase in the costs. Furthermore, the bifurcation 33' of upper and lower clamping sections 43' and 44' fails to provide an aesthetically integral impression.

FIG. 11 shows a partial, exploded perspective view of a further pair of conventional swimming goggles including a body 7' and a head strap 8'. Body 7' includes a strap coupling section 71' on each of two outer sides thereof. Each strap coupling section 71' includes upper and lower grooves 72' and 73' in an outer face thereof. Each groove 72', 73' includes a through-hole 74', 75' extending from the front face through a rear face of one of strap coupling sections 71'. Each of two ends of head strap 8' is extended through through-hole 74' of one of strap coupling section 71' and through-hole 75' of the same strap coupling section 71'. Each end of head strap 8' is received in upper and lower grooves 72' and 73' of one of strap coupling sections 71' and includes upper and lower clamping sections 81' and 82' while providing an aesthetically integral impression. However, head strap 8' is liable to disengage from upper and lower grooves 72' and 73' in use (see FIG. 12) such that the ears of the user are pressed against by lower clamping sections 810.

A need exists for a pair of swimming goggles with a reliable strap positioning effect to prevent the ears of the user from being pressed against during use while providing an aesthetically integral impression.

BRIEF SUMMARY OF THE INVENTION

A pair of swimming goggles according to the preferred teachings of the present invention includes a body having a strap coupling section formed on each of two sides thereof. Each strap coupling section includes front and rear faces. The front face of each strap coupling section includes upper and lower grooves spaced in a vertical direction. The upper groove includes an upper slot formed in an outer end thereof and extending from the front face through the rear face. The upper groove further includes an upper through-hole formed in an inner end thereof and extending from the front face through the rear face. The lower groove includes a lower slot formed in an outer end thereof and extending from the front face through the rear face. The lower slot is located below and spaced from the upper slot in the vertical direction. The lower groove further includes a lower through-hole formed in an inner end thereof and extending from the front face through the rear face. The lower through-hole is located below and spaced from the upper through-hole in the vertical direction. At least one head strap includes two ends each extending from a rear side of one of the strap coupling sections through one of the upper and lower slots to a front side of the strap coupling section, through one of the upper and lower grooves and one of the upper and lower through-holes to the rear side of the strap coupling section, through the other of the upper and lower through-holes to the front side of the strap coupling section, and through the other of the upper and lower grooves and the other of the upper and lower slots to the rear side of the strap coupling section, with the head strap forming upper and lower clamping sections.

In a most preferred form, each strap coupling section includes a bridge on an outer end thereof. The bridge includes upper and lower recessed portions formed on a rear face thereof and respectively in communication with the upper and lower slots. The at least one head strap is received and positioned in the upper and lower recessed portions. Furthermore, the rear face of each strap coupling section further includes a recess extending between the upper and lower holes, and the at least one head strap is received and positioned in the recess.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
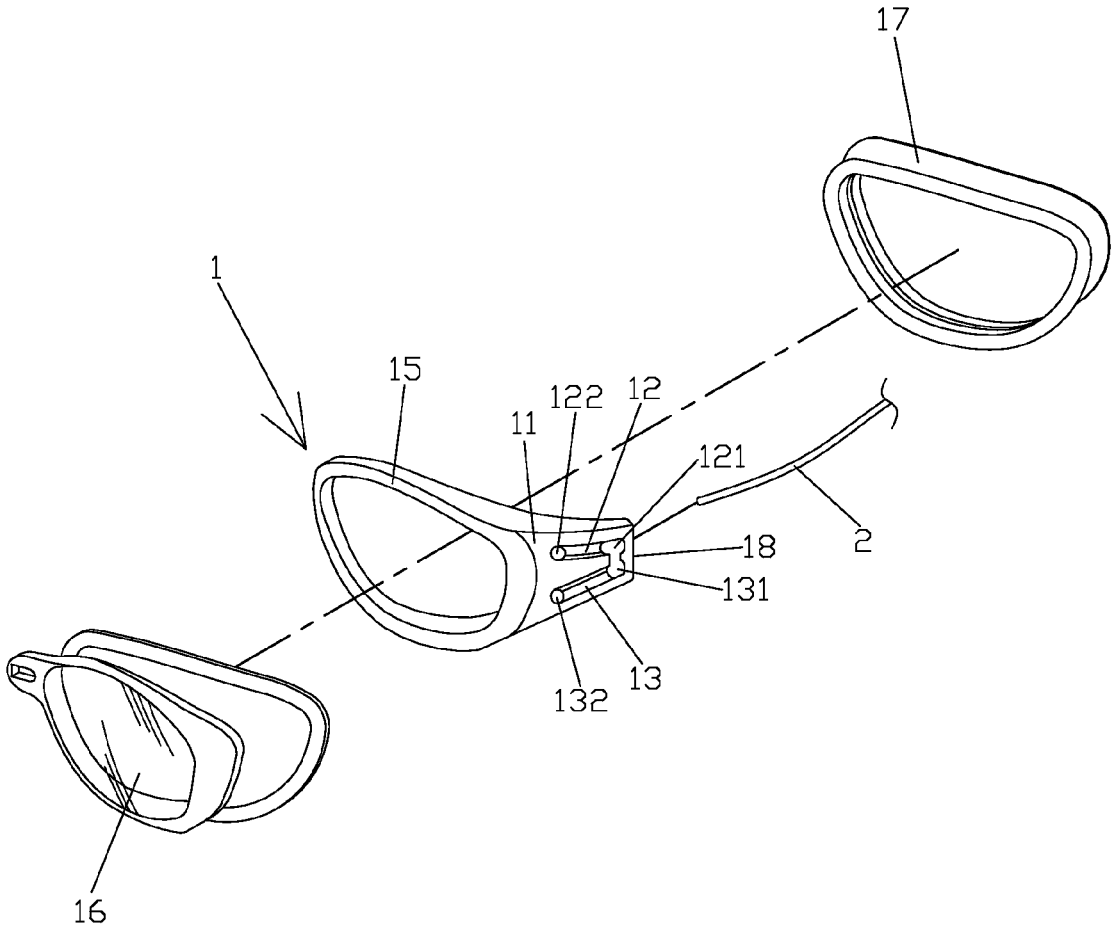
FIG. 1 shows a partial, exploded, perspective view of a pair of swimming goggles according to the preferred teachings of the present invention.
Figure 2:
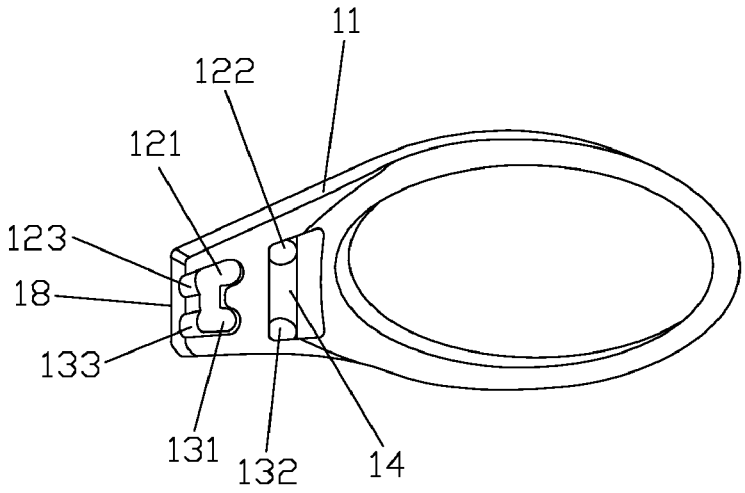
FIG. 2 shows a rear, perspective view of a portion of a body of the swimming goggles of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

A pair of swimming goggles according to the preferred teachings of the present invention is shown in FIGS. 1-6 of the drawings and includes a body 1 and a head strap 2 made of elastic material. According to the preferred form shown, body 1 includes a frame 15, two lenses 16 (only one is shown) mounted to frame 15, and a padding member 17 mounted to each lens 16. Note that only a left half portion of frame 15 is shown, the right half portion of frame 15 has a structure symmetric to the left half portion relative to a central line of frame 15. A strap coupling section 11 is formed on each of two sides of frame 15 and includes front and rear faces. Upper and lower grooves 12 and 13 are formed on the front face of each strap coupling section 11 and spaced in a vertical direction. Upper groove 12 includes an upper slot 121 formed in an outer end thereof and extending from the front face through the rear face. Upper groove 12 further includes an upper through-hole 122 formed in an inner end thereof and extending from the front face through the rear face. Lower groove 13 includes a lower slot 131 formed in an outer end thereof and extending from the front face through the rear face. Lower slot 131 is located below and spaced from upper slot 121 in the vertical direction. Lower groove 13 further includes a lower through-hole 132 formed in an inner end thereof and extending from the front face through the rear face. Lower through-hole 132 is located below and spaced from upper through-hole 122 in the vertical direction. Note that a bridge 18 is formed on an outer end of each strap coupling section 11 due to provision of upper and lower slots 121 and 131. Upper and lower recessed portions 123 and 133 are formed on a rear face of bridge 18 of each strap coupling section 11 and respectively in communication with upper and lower slots 121 and 131. A recess 14 is formed in the rear face of each strap coupling section 11 and extends in the vertical direction between upper and lower through-holes 122 and 132.

Figure 3:
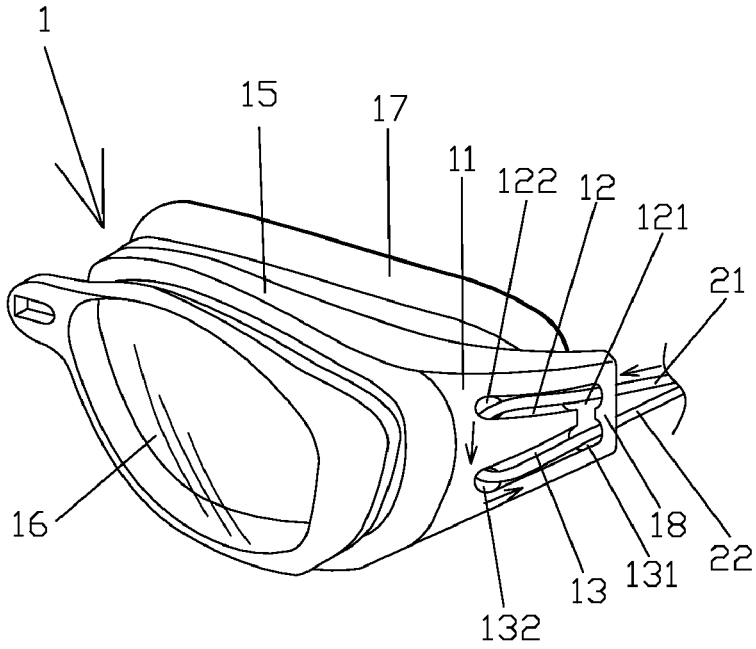
FIG. 3 shows a partial, front, perspective view of the swimming goggles of FIG. 1 after assembly.
Figure 4:
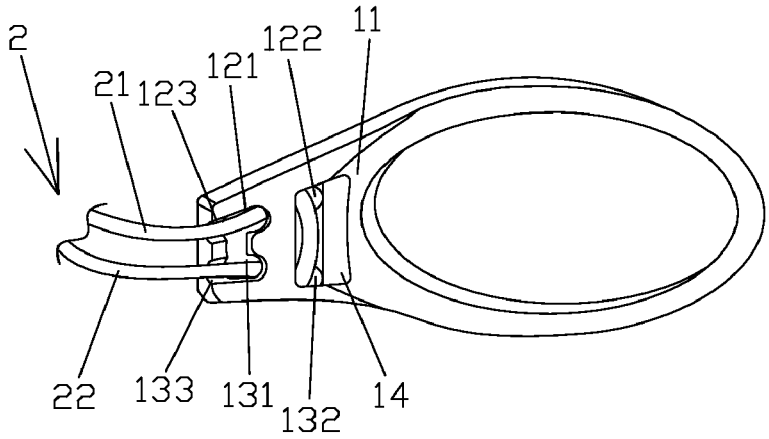
FIG. 4 shows a partial, rear, perspective view of a head strap and the body of FIG. 2 after assembly.
Figure 5:
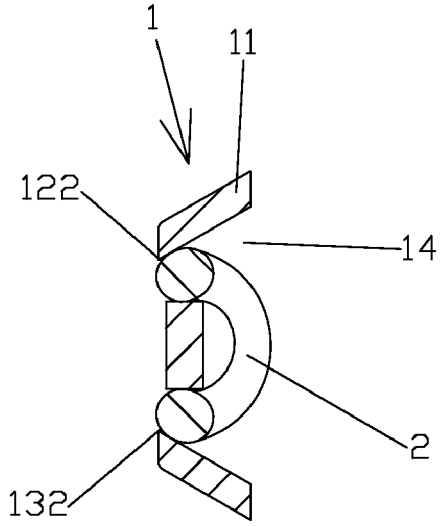
FIG. 5 shows a cross-sectional view of the head strap and the body of FIG. 5.
Figure 6:
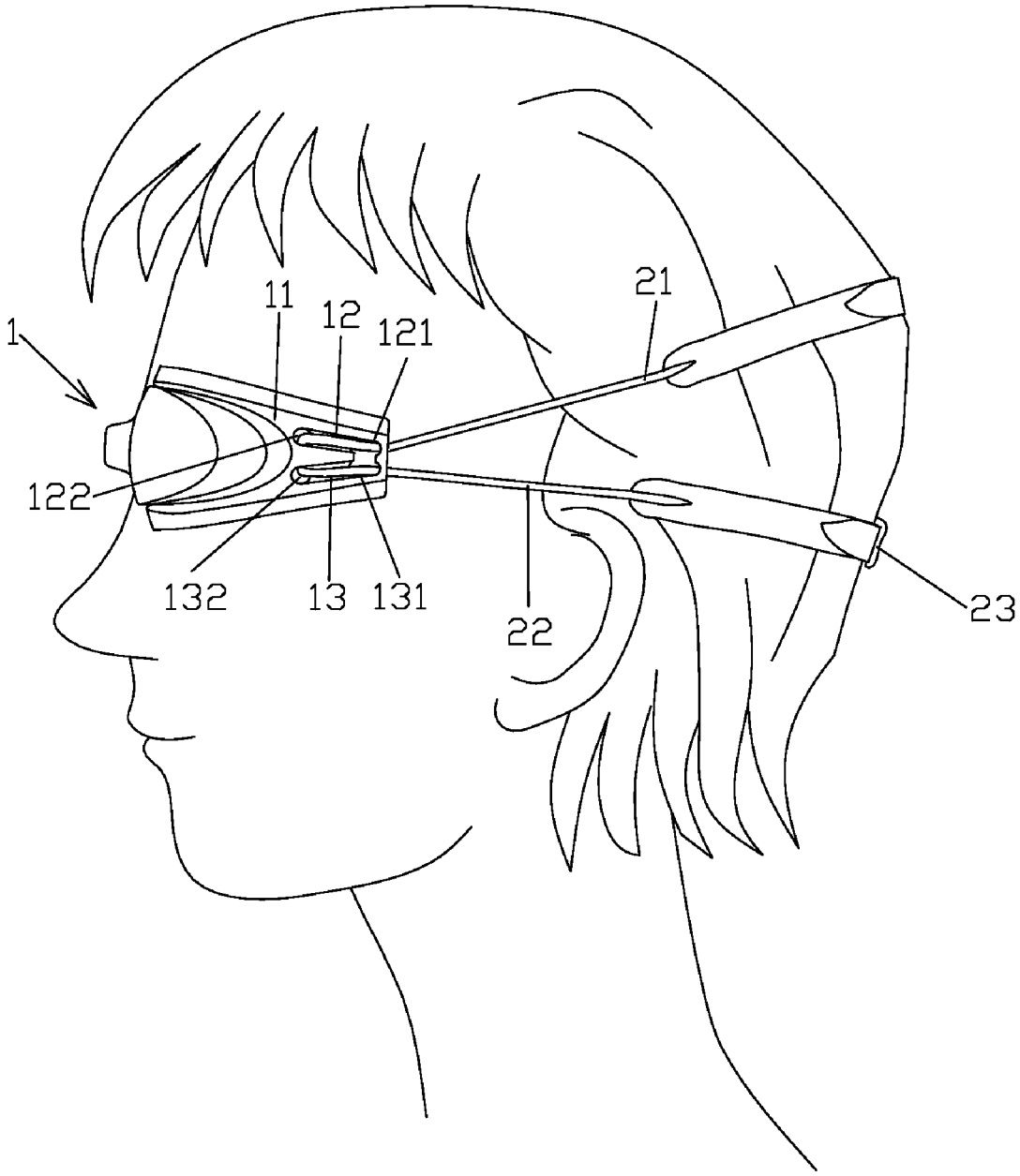
FIG. 6 shows a schematic side view illustrating a user wearing the swimming goggles of FIG. 1.
Figure 7:
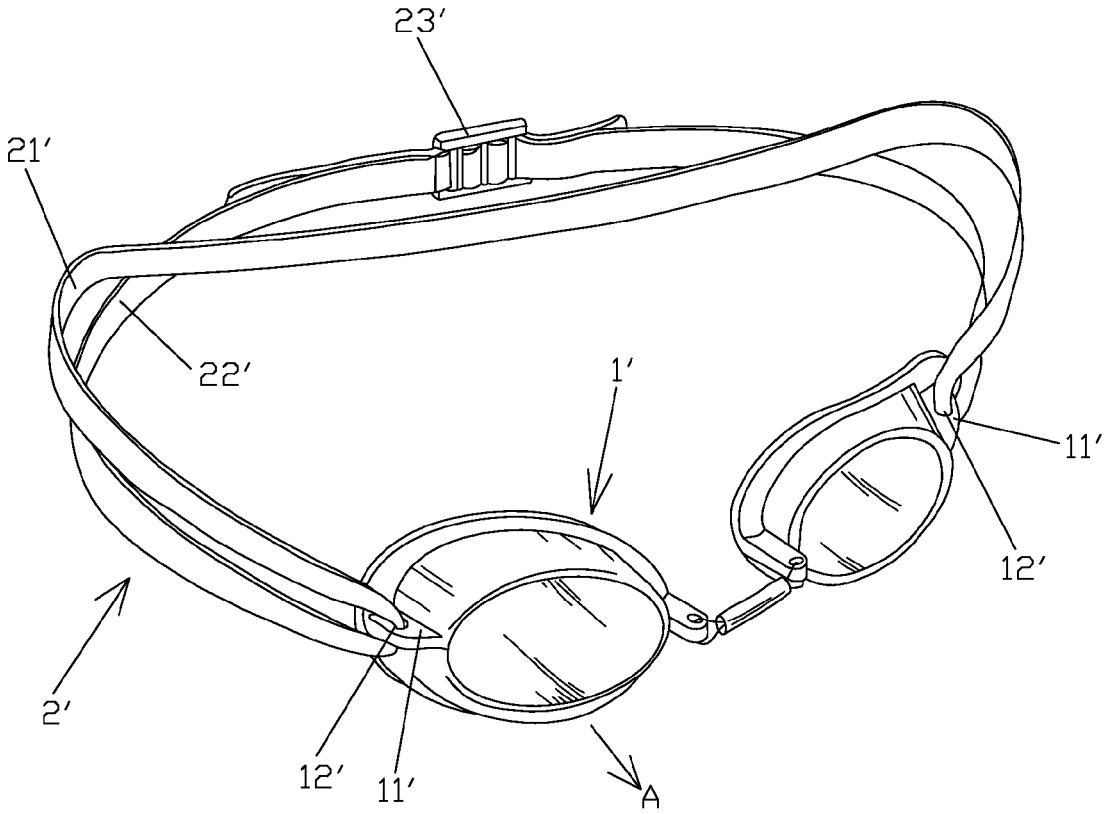
F I G . 7 PRIOR ART
FIG. 7 shows a perspective view of a pair of conventional swimming goggles.
Figure 8:
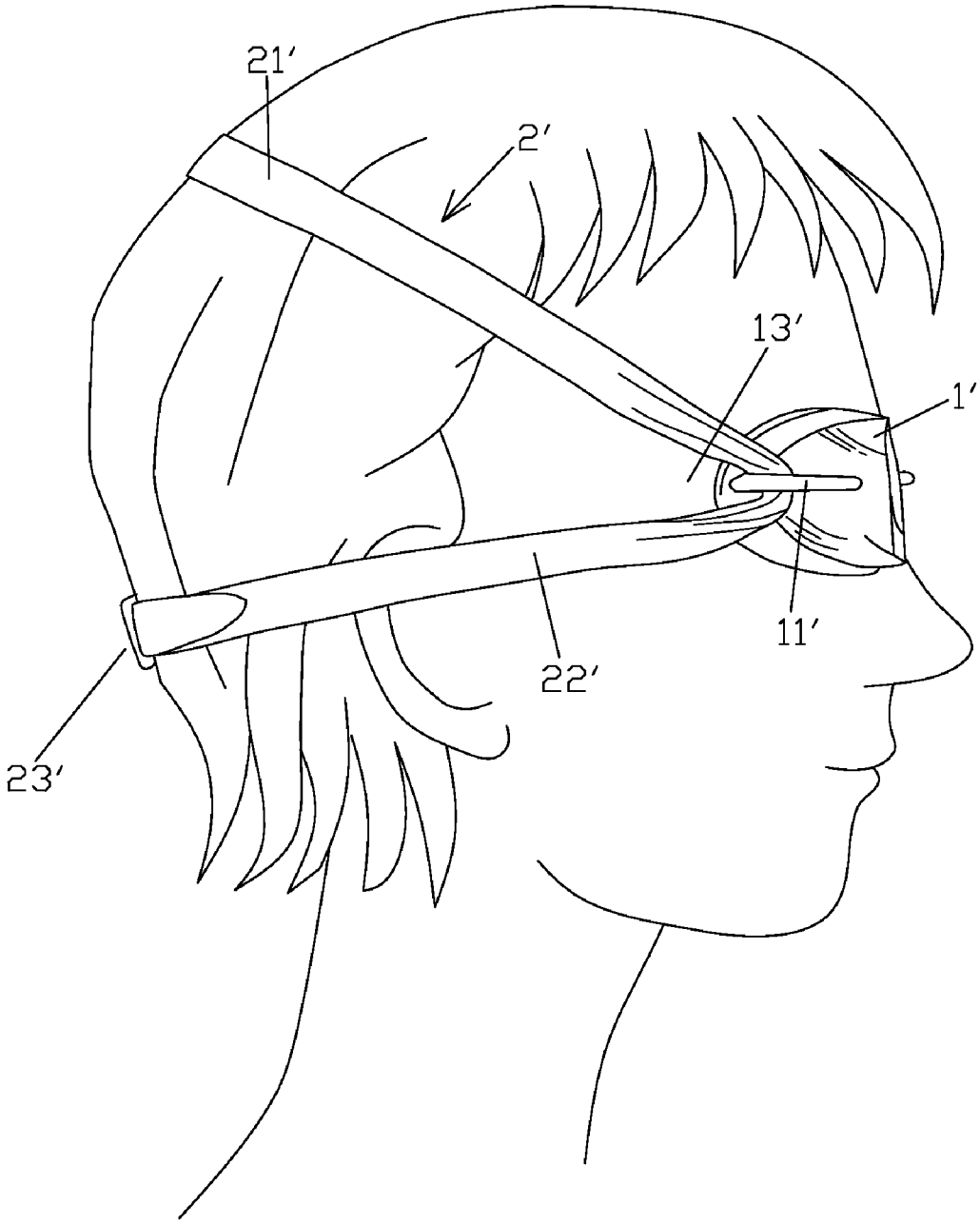
F I G . 8 PRIOR ART
FIG. 8 shows a schematic side view illustrating a user wearing the swimming goggles of FIG. 7.
Figure 9:
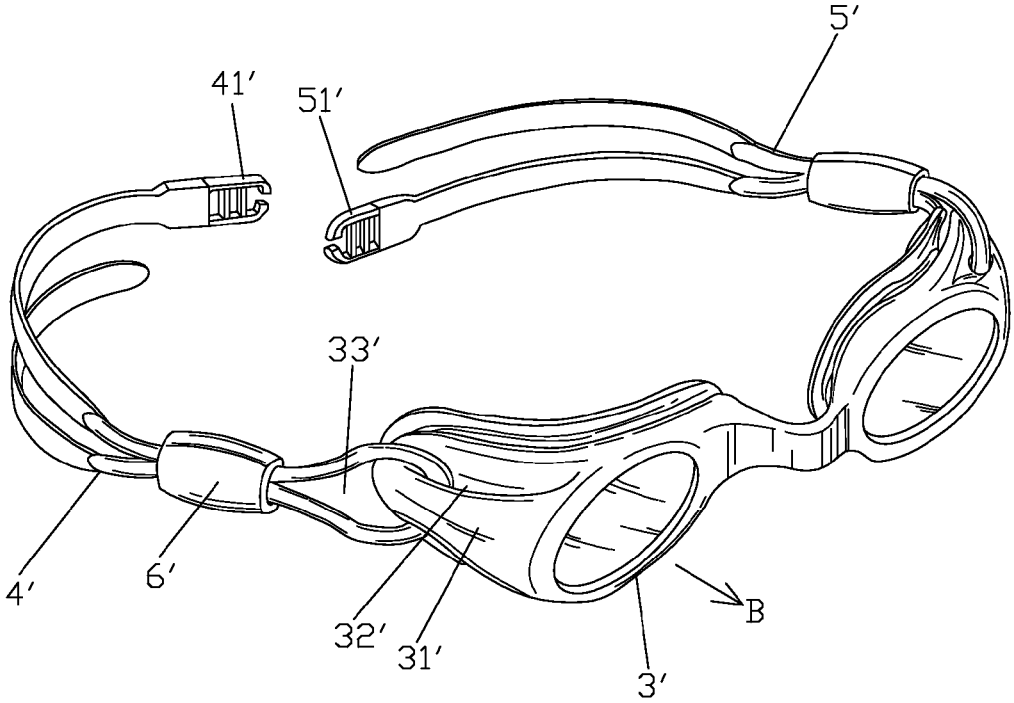
F I G . 9 PRIOR ART
FIG. 9 shows a perspective view of another pair of conventional swimming goggles.
Figure 10:
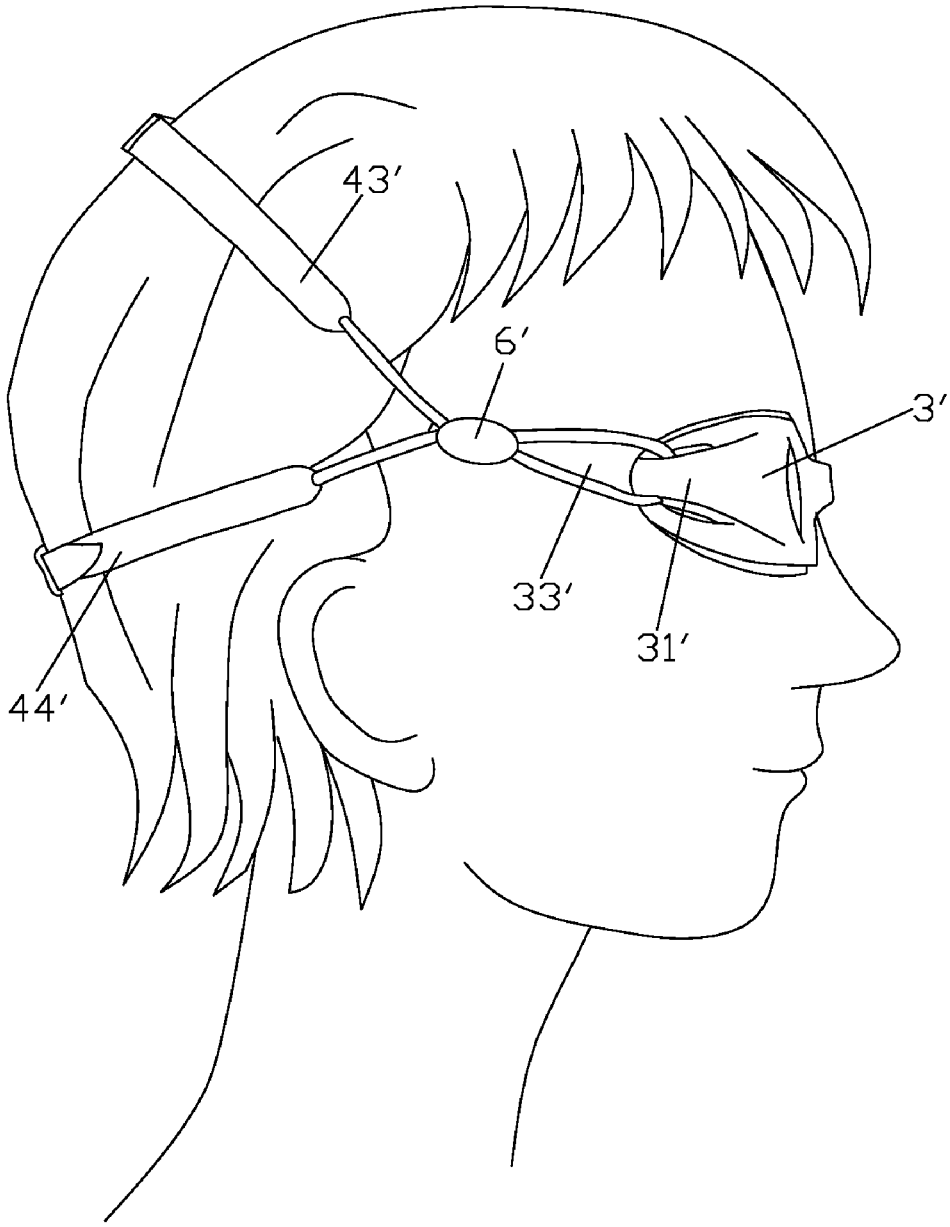
F I G . 10 PRIOR ART
FIG. 10 shows a schematic side view illustrating a user wearing the swimming goggles of FIG. 9.
Figure 11:
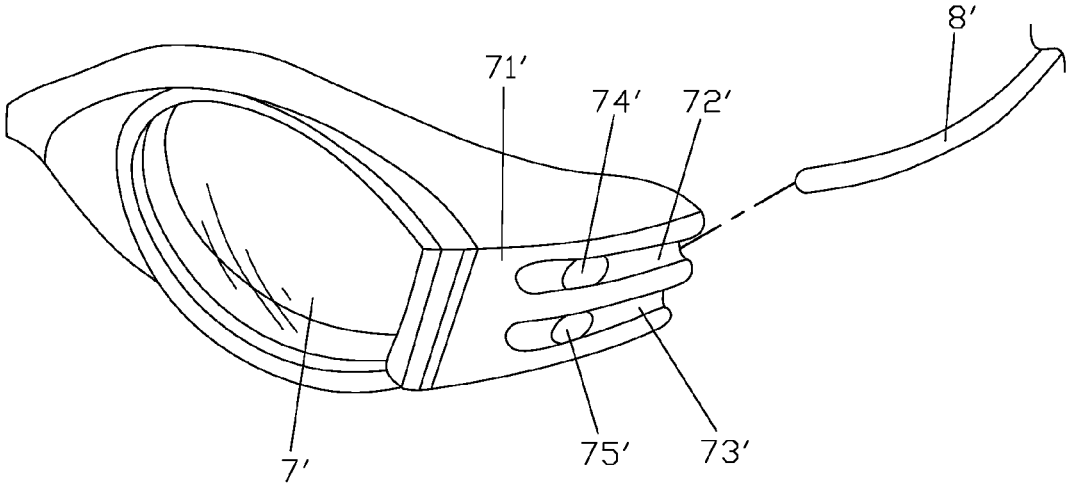
F I G . 11 PRIOR ART
FIG. 11 shows a partial, exploded perspective view of a further pair of conventional swimming goggles.
Figure 12:
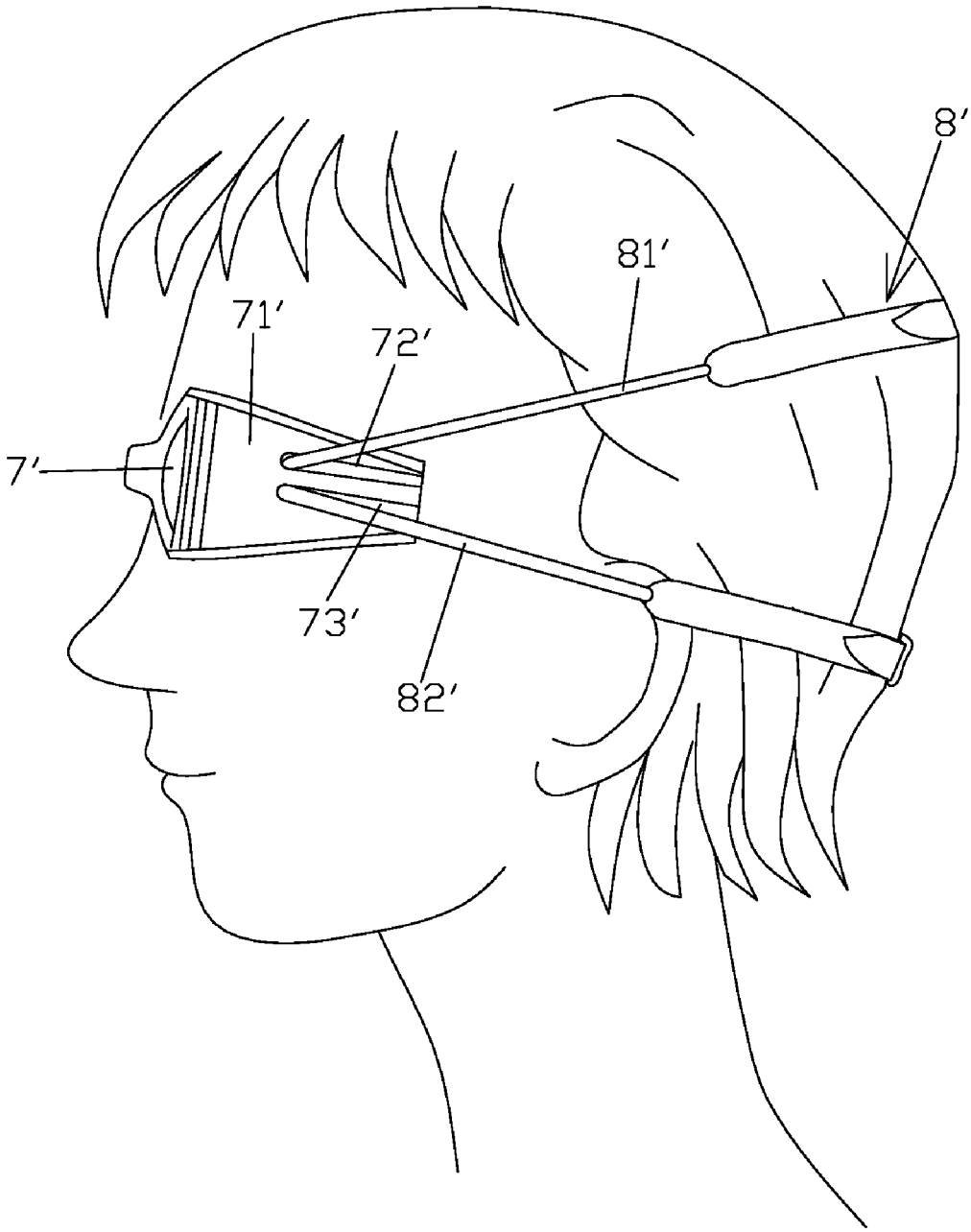
F I G . 12 PRIOR ART
FIG. 12 shows a schematic view illustrating a user wearing the swimming goggles of FIG. 11.

With reference to FIGS. 3-5, in assembly, each of two ends of head strap 2 is extended from a rear side of one of strap coupling sections 11 through upper slot 121 of strap coupling section 11 to a front side of strap coupling section 11. Then, the end of head strap 2 is extended through upper groove 12 and upper through-hole 121 to the rear side of strap coupling section 11. Next, the end of head strap 2 is extended through recess 14 and lower through-hole 132 to the front side of strap coupling section 11 and then extended through lower groove 13 and lower slot 131 to the rear side of strap coupling section 11, with head strap 2 forming upper and lower clamping sections 21 and 22 (FIG. 6). A buckle 23 (FIG. 6) can be coupled to the ends of head strap 2 to allow adjustment of a length of head strap 2. It can be appreciated that each end of head strap 2 can be extended in sequence through lower slot 131, lower groove 13, lower through-hole 132, recess 14, and upper through-hole 122, upper groove 12, and upper slot 121 of one of strap coupling sections 11, with head strap 2 forming upper and lower clamping sections 21 and 22.

Lower clamping section 22 will not move to a position pressing against ears of the user, for head strap 2 can not disengage from lower groove 13 due to provision of bridge 18. Furthermore, head strap 2 is received and positioned in recess 14 and recessed portions 123 and 133 of each strap coupling section 11, providing a reliable strap-positioning effect and enhanced assembling stability. Further, the pair of swimming goggles according to the preferred teachings of the present invention provides an aesthetically integral impression, for bifurcations in conventional swimming goggles of FIGS. 7-10 do not exist in the pair of swimming goggles according to the preferred teachings of the present invention.

Now that the basic teachings of the present invention have been explained, many extensions and variations will be obvious to one having ordinary skill in the art. For example, padding members 17 can be omitted. Furthermore, strap coupling sections 11 can be formed on lenses 16 or other components of body 1 instead of frame 15. Further, two head straps 2 can be utilized to respectively couple with strap coupling sections 11.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A pair of swimming goggles comprising: a body including a strap coupling section formed on each of two sides thereof, with each said strap coupling section including front and rear faces, with the front face of each said strap coupling section including upper and lower grooves spaced in a vertical direction, with the upper groove including an upper slot formed in an outer end thereof and extending from the front face through the rear face, with the upper groove further including an upper through-hole formed in an inner end thereof and extending from the front face through the rear face, with the lower groove including a lower slot formed in an outer end thereof and extending from the front face through the rear face, with the lower slot being located below and spaced from the upper slot in the vertical direction, with the lower groove further including a lower through-hole formed in an inner end thereof and extending from the front face through the rear face, with the lower through-hole being located below and spaced from the upper through-hole in the vertical direction; and at least one head strap including two ends each extending from a rear side of one of the strap coupling sections through one of the upper and lower slots to a front side of the strap coupling section, through one of the upper and lower grooves and one of the upper and lower through-holes to the rear side of the strap coupling section, through another of the upper and lower through-holes to the front side of the strap coupling section, and through another of the upper and lower grooves and another of the upper and lower slots to the rear side of the strap coupling section, with the head strap forming upper and lower clamping sections, with each said strap coupling section including a bridge on an outer end thereof, with the bridge including upper and lower recessed portions formed on a rear face thereof and respectively in communication with the upper and lower slots, and with said at least one head strap being received and positioned in the upper and lower recessed portions.

2. A pair of swimming goggles comprising: a body including a strap coupling section formed on each of two sides thereof, with each said strap coupling section including front and rear faces, with the front face of each said strap coupling section including upper and lower grooves spaced in a vertical direction, with the upper groove including an upper slot formed in an outer end thereof and extending from the front face through the rear face, with the upper groove further including an upper through-hole formed in an inner end thereof and extending from the front face through the rear face, with the lower groove including a lower slot formed in an outer end thereof and extending from the front face through the rear face, with the lower slot being located below and spaced from the upper slot in the vertical direction, with the lower groove further including a lower through-hole formed in an inner end thereof and extending from the front face through the rear face, with the lower through-hole being located below and spaced from the upper through-hole in the vertical direction; and at least one head strap including two ends each extending from a rear side of one of the strap coupling sections through one of the upper and lower slots to a front side of the strap coupling section, through one of the upper and lower grooves and one of the upper and lower through-holes to the rear side of the strap coupling section, through another of the upper and lower through-holes to the front side of the strap coupling section, and through another of the upper and lower grooves and another of the upper and lower slots to the rear side of the strap coupling section, with the head strap forming upper and lower clamping sections, with the rear face of each said strap coupling section further including a recess extending between the upper and lower holes, and with said at least one head strap being received and positioned in the recess.

* * * * *